US006596942B2

(12) United States Patent
Ito et al.

(10) Patent No.: US 6,596,942 B2
(45) Date of Patent: Jul. 22, 2003

(54) COLOR ARRANGEMENT OF ELECTRICAL CABLES FOR VEHICLES

(75) Inventors: Takeharu Ito, Yokkaichi (JP); Kenichi Uchiyama, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/166,120

(22) Filed: Jun. 11, 2002

(65) Prior Publication Data

US 2002/0189843 A1 Dec. 19, 2002

(30) Foreign Application Priority Data

Jun. 12, 2001 (JP) ..... 2001-177630

(51) Int. Cl.[7] ..... H01B 7/36

(52) U.S. Cl. ..... 174/72 A; 174/112; 40/316; 116/200; 191/22 R

(58) Field of Search ..... 174/72 A, 71 R, 174/72 C, 72 R, 112; 191/22 R, 28; 116/200; 40/316

(56) References Cited

U.S. PATENT DOCUMENTS 3,637,037 A * 1/1972 Doland et al. ..... 180/287
3,700,786 A * 10/1972 Lawrenson ..... 174/72 A
4,114,014 A * 9/1978 Shogo et al. ..... 219/56
4,415,765 A * 11/1983 Iwasa et al. ..... 174/72 A
4,424,627 A * 1/1984 Tarbox ..... 29/857
4,711,025 A * 12/1987 DeSanto ..... 29/854
5,470,253 A * 11/1995 Siems et al. ..... 439/491
5,862,774 A * 1/1999 Moss ..... 116/200
5,917,151 A * 6/1999 O'Brien et al. ..... 174/72 A
6,161,278 A * 12/2000 Easter et al. ..... 29/749
6,291,770 B1 * 9/2001 Casperson ..... 174/72 A
6,447,326 B1 * 9/2002 Teach et al. ..... 439/460
6,457,165 B1 * 9/2002 Ishikawa et al. ..... 716/12

* cited by examiner

*Primary Examiner*—Dean A. Reichard
*Assistant Examiner*—Adolfo Nino
(74) *Attorney, Agent, or Firm*—Greenblum & Berstein, P.L.C.

(57) ABSTRACT

The object of the invention is to reduce the number of colors provided on electrical cables wired in a vehicle. The unitary wire harness containing the greatest number of electrical cables is taken as the critical harness. The critical number of different color markings is then determined from the following formula:

$$R=A/B+C/B \quad (I)$$

wherein A is the number of electrical cables contained in the critical unitary wire harnesses, B is the number of connectors to be engaged with the critical unitary wire harness, and C is the number of terminal receiving elements contained in all of the connectors. The critical number of different cable color markings thus obtained allows the reduction of the number of different cable color markings, and the electrical cables of the same cable color marking can be differentiated when they are connected to a connector.

20 Claims, 6 Drawing Sheets

COLOR ARRANGEMENT OF ELECTRICAL CABLES FOR VEHICLES

BACKGROUND OF THE INVENTION

1. Field of the Invention

The present invention relates to a wire harness such as, for example, for vehicle or automotive applications, that includes several unitary wire harnesses each containing a plurality of electrical cables. In particular, the invention relates to colored electrical cables.

2. Description of Background Information

A typical automobile is usually wired with hundreds of electrical cables. These electrical cables are assembled into several unitary wire harnesses, each unitary wire harness being assigned to a specific car section.

As shown in FIG. 1A, such unitary wire harnesses include, for instance, an engine compartment harness W/H-1, an engine harness W/H-2 wired above the engine, a cowl harness W/H-3 wired in the dash panel (cowl panel), an instrument panel harness W/H-4, a floor harness W/H-5 wired from the front side to the rear side along the car floor, a door harness W/H-6 wired in the doors on both sides, and a roof harness (not shown in the figure) wired along the car roof.

Among them, a large-scale wire harness, such as an engine harness, an engine compartment harness, a cowl harness and an instrument panel harness, contains at least thirty to fifty, and typically one hundred to three hundred electrical cables.

In a unitary wire harness such as shown in FIG. 1B, a number of electrical cables W are bundled and taped, so as to form a trunk section and branch sections. Each end portion of the electrical cables is terminated with a connector K. Further, certain determined positions of the trunk and branch sections are mounted with fitting members such as clips to be hooked to a car body, protectors for safeguarding the harness, or corrugated tubes.

As shown in FIG. 2, an end portion of each electrical cable W is fitted with an electrical terminal T, and the latter is inserted into a corresponding terminal enclosure a, b or c, etc., formed in a connector K. During this operation, workers are susceptible of making connection errors. To avoid such mistakes, the electrical cables are differentiated by colors.

As shown in FIG. 3, a first electrical cable 5 is composed of a core wire aggregate 1 and an insulator coating 2. The latter has a plain (or solid) base color 3*a* (i.e. dominant or background color) in suitable colors, such as, red, blue, yellow, green, black or the like. A second electrical cable 6 has a plain base color 3*a* same as for the first electrical cable 5, and is further provided with, for example, two stripes 3*b*. The plain base colors 3*a* and colors of the stripes are thereby differentiated, so that workers can differentiate those electrical cables. The base color 3*a* may be provided in the entire insulator coating 2, or only on its external surface. By contrast, the stripes 3*b* are colored only on the external surface of the insulator coating.

The first and second electrical cables W may be respectively provided or spotted with identification codes 3*c* in suitable colors such as silver, red or black, etc., at given intervals along their length. The shape of the identification codes 3*c* is a function of properties such as, for example, the material and thickness of the insulator coating, the diameter of the core wire aggregate, the size of the electrical cable, etc. However, these designation identification codes 3*c* are not included in the different cable color markings in the sense of the invention, beside the plain base colors 3*a* and the striped cable colors 3*b*.

As can be understood from above, many types of cable color may be used in an automobile. Further, a work bench for mounting unitary wire harnesses is usually provided with an arrangement table such as shown e.g. in FIG. 5A. The color of an electrical cable W is made to correspond to a particular terminal enclosure among a plurality of terminal receiving means of connector K, to which the cables are to be inserted, so that erroneous connections can be avoided. In other words, the cable color sets are differentiated as a function of the destination of the electrical cables W (e.g. electrical cables W destined for a circuit). A circuit can thus be connected by inserting a given colored cable into the corresponding terminal enclosure. When the correspondence is erroneous, a desired circuit cannot be constructed.

One difficulty of harness arrangement resides in the fact that connectors in a vehicle or an automobile are initially joined to existing electric parts, for example, electronic control units and junction boxes, and the connections of unitary wire harnesses must be adapted to these situations. Further, a unitary wire harness may be connected between several connectors by crossing with other partially-connected wire harnesses, so that the electrical cables of one harness intertwine with those of other harnesses, and it is often difficult to attribute these cables to their terminal receiving elements in a consistent manner.

The electrical cables W to be engaged into terminal receiving means, in the form of enclosures or receptacles a, b and c etc. of a connector K, are identified by the corresponding cable colors. As the number of terminal receiving elements multiplies, the types of color to be used must also be multiplied so as to avoid misconnections.

Recent years have witnessed the multiplication of the number of terminal receiving elements formed in each connector K. Nowadays, its number sometimes reaches forty. Accordingly, many types of cable color are now being used. For instance, thirteen base colors are combined with different stripe colors, yielding, for example, forty six kinds of cable color.

However, when the cable colors are multiplied, the electrical cables produced become much more expensive. In addition, when the cables' size is small, the width of the stripe colors and that of the base colors become undistinguishable. As a result, it becomes difficult not only to identify the base colors, but also to distinguish the stripe colors from the base colors. This makes the workers' task particularly burdensome.

SUMMARY OF THE INVENTION

The present invention thus has for object to reduce the types of cable color required without risk of connection errors, to reduce the manufacturing costs of cables, and to alleviate fatigue on workers due to color differentiation efforts. To this end, there is provided a method for determining a critical number of colors for the electrical cables constituting a wire harness such as, for example, a vehicle or an automotive wire harness. The wire harness includes a plurality of unitary wire harnesses to be engaged with a given number of connectors. Each of the unitary wire harnesses contains a plurality of electrical cables which respectively have a different color marking and include an electrical terminal attached to at least one end thereof, and each of the connectors includes a plurality of terminal receiving elements respectively configured to receive a corresponding electrical terminal, so that each of the unitary wire harnesses can be engaged with a given number of connectors. The above method further comprises:

selecting a critical unitary wire harness among the plurality of unitary wire harnesses;

determining the critical number of different color markings to be contained in the critical unitary wire harness on the basis of the empirical formula:

$$R=A/B+C/B \quad \text{(I)}$$

in which R is the critical number of different color markings; A is the total number of electrical cables contained in the critical unitary wire harness; B is the total number of connectors to be engaged with the critical unitary wire harness; and C is the total number of terminal receiving elements contained in all of the connectors to be engaged with the critical unitary wire harness; and setting the total number of different cable color markings necessary for each of the plurality of unitary wire harnesses to be equal to or less than the critical number of different color markings.

Selecting a critical unitary wire harness may include choosing a unitary wire harness containing either the greatest number of electrical cables or the greatest number of connectors.

Determining the critical number of different color markings may include multiplying member R by a number equal to at least about 1.5, when C/B is less than about 9.

Preferably, the above number equal to at least about 1.5 is a number between about 1.5 and about 2.0, inclusive.

Further, determining the critical number of different color markings may include rounding up R to the nearest higher integer value, when said member R is a decimal number.

Typically, the above different color markings may include a plain base color and/or a striped base color.

Preferably, the different color markings are composed solely of plain base colors.

Preferably yet, the different color markings include thirteen types of color at the maximum.

Typically, all of the different color markings used for a specific connector are different from one another, or the terminal receiving elements in a specific connector are arranged such that either the same different color markings are not placed in adjacent positions, or are placed in different sub-classes which are defined for the terminal receiving elements.

Further, selecting a critical unitary wire harness may include choosing a unitary wire harness containing at least thirty electrical cables.

Alternatively, the different color markings may further be provided or spotted with identification codes along the length of the electrical cables at given intervals.

The invention also relates to a system for determining a critical number of colors for the electrical cables constituting a wire harness such as, for example, for automotive applications, the wire harness including a plurality of unitary wire harnesses to be engaged with a given number of connectors, each of the unitary wire harnesses containing a plurality of electrical cables which respectively have a different color marking and include an electrical terminal attached to at least one end thereof, and each of the connectors includes a plurality of terminal receiving elements respectively configured to receive a corresponding electrical terminal, so that each of the unitary wire harnesses can be engaged with a given number of connectors. The above system includes:

a selector that selects a critical unitary wire harness among said plurality of unitary wire harnesses;

an element that determines the critical number of different color markings to be contained in said critical unitary wire harness on the basis of the empirical formula:

$$R=A/B+C/B \quad \text{(I)}$$

in which R is the critical number of different color markings; A is the total number of electrical cables contained in said critical unitary wire harness; B is the total number of connectors to be engaged with said critical unitary wire harness; and C is the total number of terminal receiving elements contained in all of the connectors to be engaged with said critical unitary wire harness; and a device that sets the total number of different cable color markings necessary for each of said plurality of unitary wire harnesses to be equal to or less than said critical number of different color markings.

In the above system, the selector that selects a critical unitary wire harness includes a device that chooses a unitary wire harness containing either the greatest number of electrical cables or the greatest number of connectors.

Further, the element that determines the critical number of different color markings comprises a device that multiplies member R by a number equal to at least about 1.5, when C/B is less than about 9.

Typically, the different color markings include a plain base color and/or a striped base color.

Suitably, the different color markings include thirteen types of color at the maximum.

The invention further may include a wire harness for vehicle or automotive applications, including a plurality of unitary wire harnesses to be engaged with a given number of connectors, each of the unitary wire harnesses containing a plurality of electrical cables which respectively have a different color marking and include an electrical terminal attached to at least one end thereof, the unitary wire harnesses being configured to be engaged with the connectors including a plurality of terminal receiving elements for receiving a corresponding electrical terminal. The above wire harness includes:

a critical unitary wire harness selected among the plurality of unitary wire harnesses;

a critical number of different color markings to be contained in the critical unitary wire harness, determined on the basis of the empirical formula:

$$R=A/B+C/B \quad \text{(I)}$$

in which R is the critical number of different color markings; A is the total number of electrical cables contained in the critical unitary wire harness; B is the total number of connectors to be engaged with the critical unitary wire harness; and C is the total number of terminal receiving elements contained in all of the connectors to be engaged with the critical unitary wire harness; and a necessary total number of different cable color markings determined for each of the plurality of unitary wire harnesses, which are equal to or less than the critical number of different color markings.

The above critical unitary wire harness may include a unitary wire harness containing either the greatest number of electrical cables or the greatest number of connectors.

Preferably, the critical number of different color markings includes member R multiplied by a number at least equal to about 1.5, when C/B is less than about 9.

Preferably yet, the different color markings include a plain base color and/or a striped base color and include a maximum of thirteen types of color.

The required number of different color markings for the invention are related to the number of electrical cables, the number of connectors, and the number of terminal receiving elements contained in a connector. These numbers are therefore taken into consideration in the above formula. The critical number of different color markings is defined for a particular unitary wire harness, so that the electrical cables, to be engaged into the terminal receiving elements of one connector, do not have a same cable color markings. The number of cable color markings for the other unitary wire harnesses is then limited to be equal to or less than the above critical number.

The first member A/B of the above empirical formula gives the mean value of electrical cables per connector. When this mean value increases, the critical number of different color markings also tends to increase.

The second member C/B of the above empirical formula gives the mean value of terminal receiving elements per connector. When this mean value increases, the critical different color markings also tends to increase.

When connectors having a small number of terminal receiving means, rather than those having a large number thereof, are preferably used, both mean values decrease. Conversely, when connectors having a large number of terminal receiving elements are preferably used, the number of different color markings is required to be greater than the mean values. In order to solve such problems, the critical number R is multiplied by a correction factor for security or safety of at least about 1.5, preferably a number chosen between about 1.5 and about 2.0, inclusive. This correction factor is obtained empirically, a value of less than about 1.5 or over about 2.0 being found not to be entirely satisfactory.

In other words, when the mean number of terminal receiving elements per connector is at least about 9, the critical number of different color markings R is not multiplied by a number of at least about 1.5, and, when the mean cavity number per connector is less than about 9, the critical number R is multiplied by a number equal to at least about 1.5.

In some unitary wire harnesses, there are employed many large-scale connectors (with a great number of terminal receiving elements), which can thus engage with a large number of electrical cables. In such a case, once the critical number of different color markings for the unitary wire harness containing the largest number of electrical cables is determined, this critical number is also sufficient to distinguish the different color markings for the other unitary wire harnesses. Accordingly, all the different color markings used in an entire system such as, for example, a vehicle or an automobile can thus be kept below the critical number of different color markings.

Instead of the greatest number of electrical cables as mentioned above, the greatest number of terminal receiving elements may be used for determining the critical unitary wire harness for the above calculation. Likewise, when the connector to be engaged with a unitary wire harness includes a mean number of terminal receiving elements of at least nine, the number of different color markings for all the unitary wire harnesses may be equal to or less than the critical number R.

Normally, the unitary wire harness containing the greatest number of electrical cables is engaged with the largest-scale connector (having the greatest number of terminal receiving elements). Sometimes, however, a unitary wire harness not containing the greatest number of electrical cables may be engaged with the largest-scale connector. However, as mentioned above, electrical cables are differentiated by many colors in order to avoid connection errors to a large-scale connector. Accordingly, in the above case, the critical number of different color markings of formula (I) is calculated on the basis of the unitary wire harness to which the largest-scale connector is engaged.

Further, by reducing the types of different cable color markings, all the electrical cables wired in the entire system such as, for example, a vehicle or an automobile may be provided or painted in a base color without having to add stripes.

In this manner, the stripe-painting process can be obviated, and the cable manufacturing costs are drastically reduced.

In particular, in the small-sized electrical cables, the cable colors can be identified more easily when they are not striped. The use of "stripeless" cable colors thus alleviate the burden on workers.

However, the plain base colors and the base colors striped in another color may be used jointly, and their total cable colors may be brought to a number equal to or less than the critical number of different color markings.

The unitary wire harnesses containing the number of different color markings equal to or less than the value obtained by formula (I) may include a total of at least thirty, at least fifty or at least one hundred electrical cables, the last being the most common.

In particular, the engine harness, the engine compartment harness or the instrument panel harness contains a great number of electrical cables. The number of their different color markings is at most the critical number obtained from the above formula.

The roof harness or the door harness contains a smaller number of electrical cables, and consequently a smaller number of different cable color markings than that obtained from the formula above.

Also in such cases, the unitary wire harness containing the greatest number of electrical cables may be taken as critical harness, and the critical number of different color markings may be calculated. As already mentioned, this critical number of different cable color markings may also be applied to unitary wire harnesses having a smaller cable number. Likewise, the number of different color markings used in the entire vehicle can be calculated from formula (I).

In most commercial automobiles, the critical number of different color markings thus calculated amounts to a value ranging from 12 to 14, especially to 13.

Accordingly, according to the present invention, the number of different color markings used for the entirety of the vehicle's electrical cables is determined to be 12 to 14 types at the most, preferably 13 types. The above number of different color markings for electrical cables may be composed of plain base colors only, or may be a mixture of plain base colors and striped base colors.

However, as the critical number of different color markings is reduced e.g. to 13, the complete set of cable colors may be constituted by the plain base colors only. In other words, all the electrical cables wired in an automobile are provided painted with thirteen types of plain base colors.

In another embodiment, the electrical cables in plain base colors or striped base colors may further be spotted with markings formed at given intervals along the length of the cable. In such a case, the cable colors with markings are not counted as different color markings within the meaning of the invention.

BRIEF DESCRIPTION OF THE DRAWINGS

The above, and the other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

An object of the present invention is to rationalize or organize the use of colors while reducing connection errors, thereby lowering harness production costs.

Figure 1A:
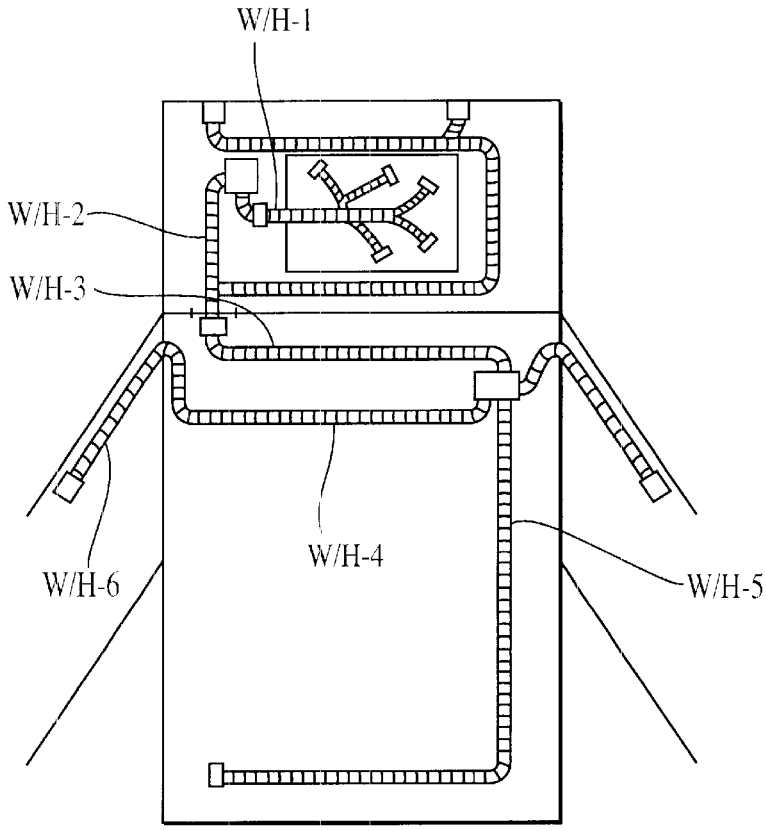
FIG. 1A PRIOR ART
FIG. 1A schematically shows unitary wire harnesses wired in several zones of an automobile.
Figure 1B:
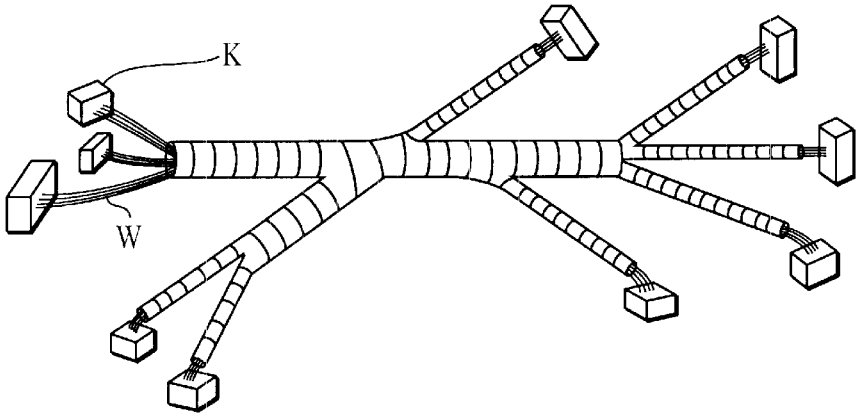
FIG. 1B PRIOR ART
FIG. 1B is a perspective view of a typical unitary wire harness.
Figure 2:
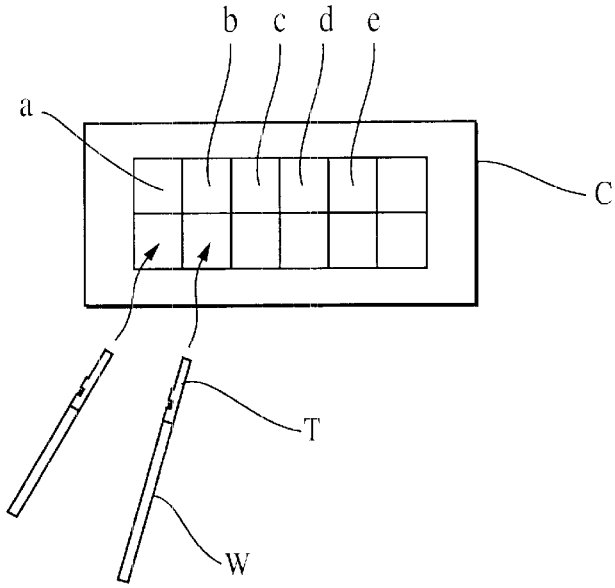
FIG. 2 PRIOR ART
FIG. 2 is a schematic view showing how electrical cables are engaged into terminal receiving means of a connector.
Figure 3:
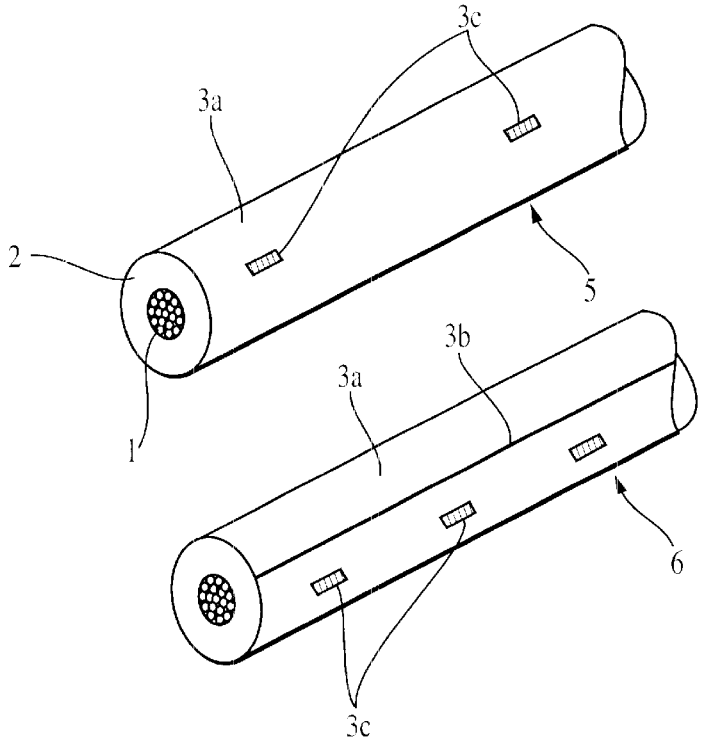
FIG. 3 PRIOR ART
FIG. 3 is a perspective view of different electrical cables in a plain base color with identification codes and in a striped base color with identification codes.

FIG. 1 shows unitary wire harnesses wired in several vehicle or automobile sections. Amongst them, the engine harness and the instrument panel harness often contain the greatest number of electrical cables.

Further, the number of connectors (or connecting members) engaged with the above two harnesses is greater than that of the connectors engaged with the other harnesses. Moreover, the connectors used for the engine harness and instrument panel harness are often what are termed multiple-pole connectors, each of which contains a high number of terminal receiving means (terminal receiving means may be, for example, enclosures, receptacles or chambers for receiving a terminal).

Figure 4A:
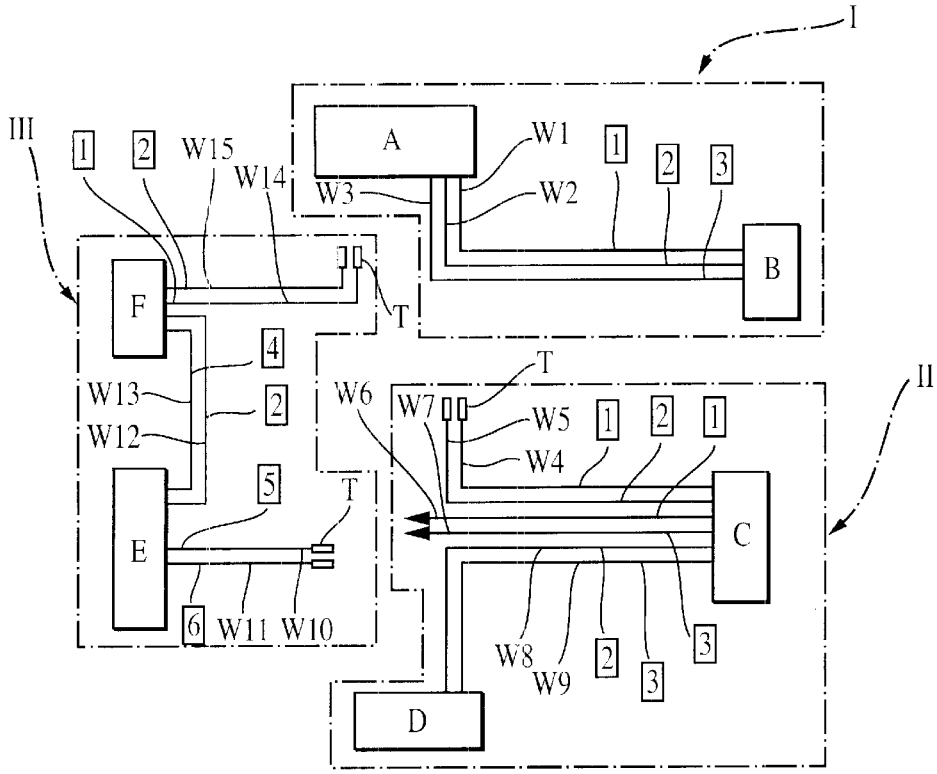
FIG. 4A PRIOR ART
FIG. 4A shows partially-connected unitary wire harnesses.
Figure 4B:
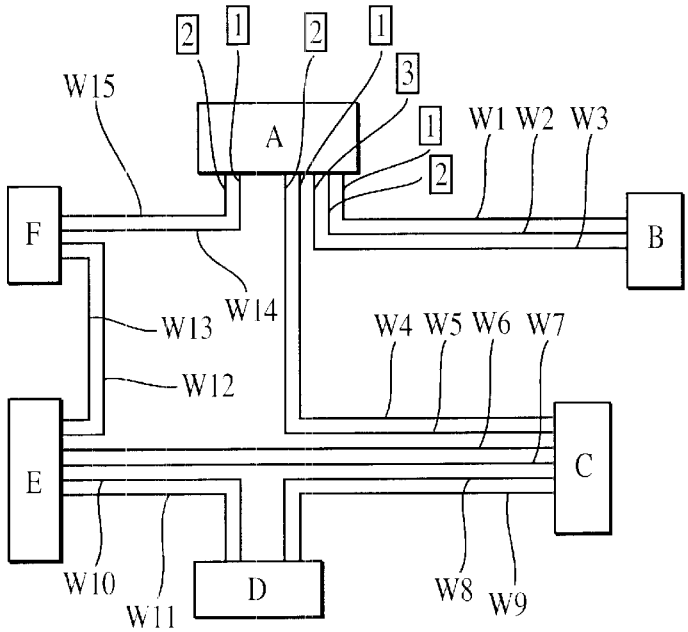
FIG. 4B PRIOR ART
FIG. 4B shows entirely-connected unitary wire harnesses.

FIG. 4A shows partially-connected wire harnesses (abbreviation W/H) I, II and III; and FIG. 4B shows entirely-connected wire harnesses W/H. In both figures, fifteen electrical cables and their different color markings are respectively designated by references W1 to W15 and 1 to 6.

In the partially-connected wire harness I, a first end of each of electrical cables W1, W2 and W3 is connected to connector A, and a second end thereof is connected to connector B. Accordingly, partially-connected wire harness I contains no dangling terminals (yet to be connected terminals). In the above wire harness, W1, W2 and W3 are painted with mutually different color units 1, 2 and 3.

In the partially-connected wire harness II, a first end of each of electrical cables W4 to W9 is connected to connector K. In contrast with partially-connected wire harness I, a second end of both W8 and W9 is connected to connector D of partially-connected wire harness II, and a second end of both W4 and W5 is connected to connector A of partially-connected wire harness I. Conversely, W6 and W7 contain dangling terminals T to be connected to connector E of partially-connected wire harness III.

W4 and W5 are both connected to connector K and connector A in the same manner. They are therefore given mutually different color markings 1 and 2.

W6 and W7 are connected to the same connector K at their first ends, and to the same connector E at their second ends. They are therefore given mutually different color markings 1 and 3.

W8 and W9 are connected to the same connector K at their first ends, and to the same connector D at their second ends. They are therefore given mutually different color markings 2 and 3.

Connector K thus contains two different color markings 1, two different color markings 2 and two different color markings 3, respectively.

In partially-connected wire harness III, W10 and W11 are connected to connector E at their first ends, and their second ends form dangling terminals T to be connected to connector D of partially-connected wire harness II. W12 and W13 are connected to connector E at their first ends, and their second ends are connected to connector F.

Likewise, W14 and W15 are connected to connector F at their first ends, and their second ends form dangling terminals T to be connected to connector A of partially-connected wire harness I.

W10 and W11 are respectively connected to the same connectors D and E. They are therefore given mutually different color markings 5 and 6.

W12 and W13 are respectively connected to the same connectors E and F. They are therefore given mutually different color markings 2 and 4.

Further, W14 and W15 are respectively connected to the same connectors F and A. They are therefore given mutually different color markings 1 and 2.

As can be understood from above, for W4 and W5, connector K of partially-connected wire harness II forms a first connecting member (for prior connection), and connector A of partially-connected wire harness I forms a second connecting member (for subsequent connection).

In the above connection procedure, connector A (second connecting member) receives, for subsequent connections, the dangling terminals T of W4 and W5 from connector K (first connecting member), and the dangling terminals T of W14 and W15 from connector F (first connecting member).

In the above case, the different color markings of W4 and W5 are respectively 1 and 2. In addition, W14 and W15 may also be given different color markings 1 and 2 respectively. In other words, W4 and W5 of connector K have a mutually different color marking, but the same as that of W14 and that of W15, respectively.

Figure 5A:
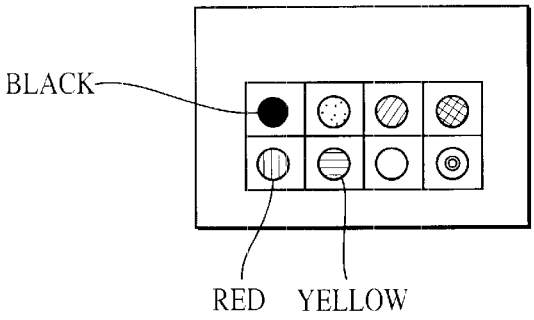
FIG. 5A shows an example of an arrangement table, in which all the electrical cables have different color markings.
Figure 5B:
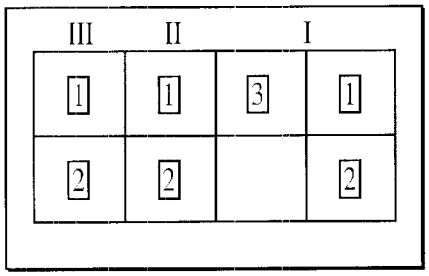
FIG. 5B shows an example of an arrangement table, in which the terminal receiving means are arranged into sub-sections, so that the electrical cables having the same color markings can be placed in different sub-sections.

In such a case, the arrangement table for the second connecting member (connector A) may contain columns designated such as, for example, I, II and III, as shown in FIG. 5B. Thus, the dangling terminals of W4 and W5 from connector K are first connected to the corresponding connector terminals (marked II in the arrangement table), and those of W14 and W15 from connector F are then connected to the corresponding connector terminals (marked III in the arrangement table). Connection errors can thus be avoided.

Figure 5C:
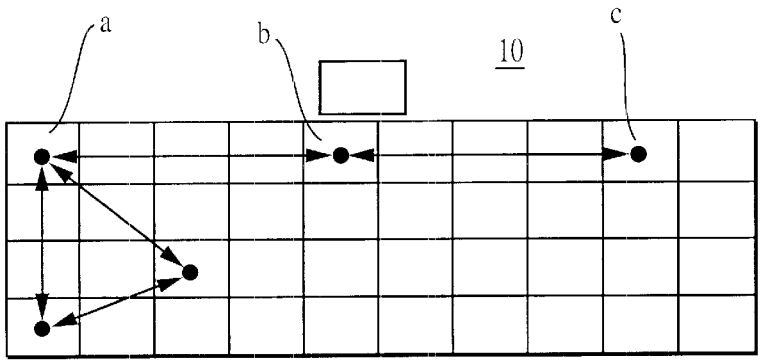
FIG. 5C shows an example of an arrangement table, in which the electrical cables having the same color markings are not placed in a side-by-side relation.

Another possibility for reducing the risk of connection errors is to place the same color units, if any, far from each other, as shown in FIG. 5C.

In subsequent connections where many errors are likely to occur, the electrical cables to be connected have respectively different color markings, so that connection errors can be avoided. Further, even if the subsequent connections must be effected from different connectors, these connections are made at different moments, so that the electrical cables from different connectors can have the same color markings without the risk of confusion.

Accordingly, it suffices to prepare the number of different color markings necessary to differentiate the electrical cables which are connected subsequently and simultaneously.

Usually, the number of subsequent connections is less than that of prior connections. Accordingly, the number of different color markings for the subsequent connections may be less than the number of different color markings necessary to prevent connection errors caused during the prior connections.

The number of different cable color markings necessary for an instrument panel harness can be calculated on the basis of formula (I). The critical number of different color markings for all of the electrical cables, wired, for example, in a vehicle or automobile of type "X" currently produced in a large scale, is calculated as follows.

In automobile of type "X", the value of C/B exceeds 9 (>9). The critical number "R" is therefore not corrected by multiplying a security or safety factor of at least about 1.5. Further, as the value obtained gives a decimal number, this number is rounded up to the nearest integer above.

The instrument panel harness of automobile "X" contains the total cable number (A) of 187, the total connector number (B) of 52 and the total number of terminal enclosures (C) of 483. Accordingly, the necessary number of distinguishing colors=(187/52)+(484/52)=12.88, rounded up to 13.

In the above automobile "X", the same value is now calculated on the basis of the engine compartment harness. In the latter harness, the value of C/B is less than 9 (<9). The critical number of different color marking units is therefore calculated by multiplying by a number equal to at least about 1.5 as follows:

The engine compartment harness contains a total cable number (A) of 155, a total connector number (B) of 53 and a total terminal enclosure number (C) of 281. Therefore, $$R = \{(155/53) + (281/53)\} \times 1.5$$
$$= 8.2 \times 1.5 = 12.3.$$

Accordingly, the critical number of distinguishing colors is thirteen (13), as in the case calculated on the basis of the instrument panel harness.

Figure 6:
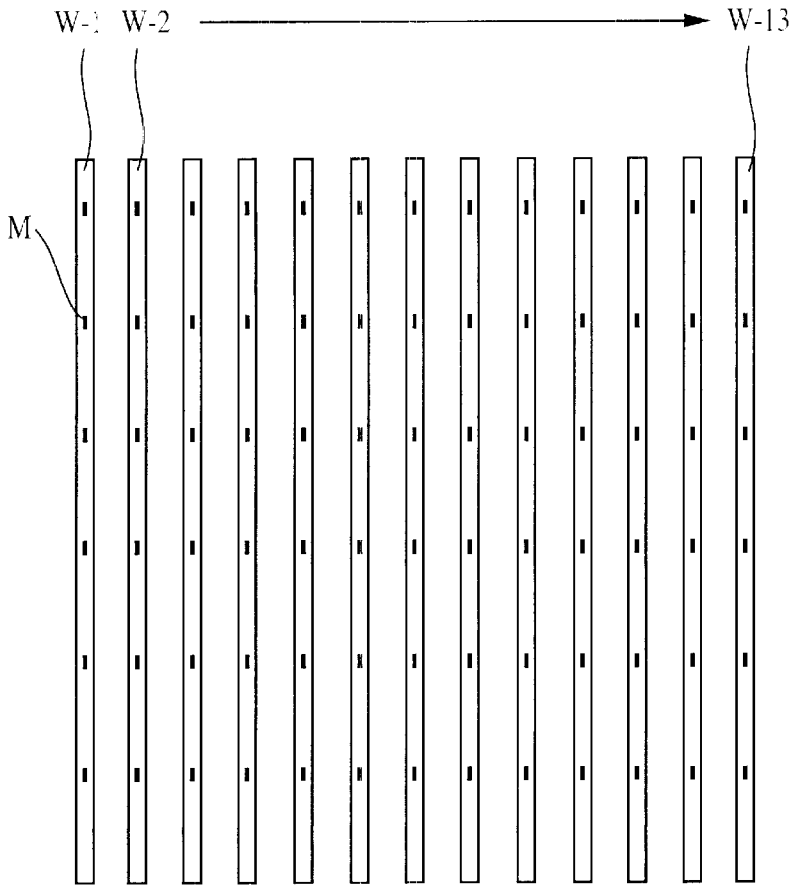
FIG. 6 shows the electrical cables having plain base colors with identification codes to be engaged into the terminal receiving means.

In this case, as shown in FIG. 6, there are provided thirteen electrical cables W1~W13 solely composed of different plain base colors. Thus, all the electrical cables, for example, in the automobile are wired with electrical cables W1 to W13 having thirteen types of different color markings. In this case, striped cable colors are not used.

In FIG. 6, identification codes "M" may be any desirable color and in the present example are silver in color. The identification codes "M" are provided on the electrical cables W1 to W13 along the respective length direction at given intervals. The identification codes "M" may be provided in spots along the length of the cables. The identification codes "M" are provided on the cables, or spotted, at a later stage as a function of the type and thickness of insulator coatings, the diameter of a core wire aggregate and the size of electrical cables, as already mentioned. These are therefore not included in the cable color units within the meaning of the present invention.

Figure 7:
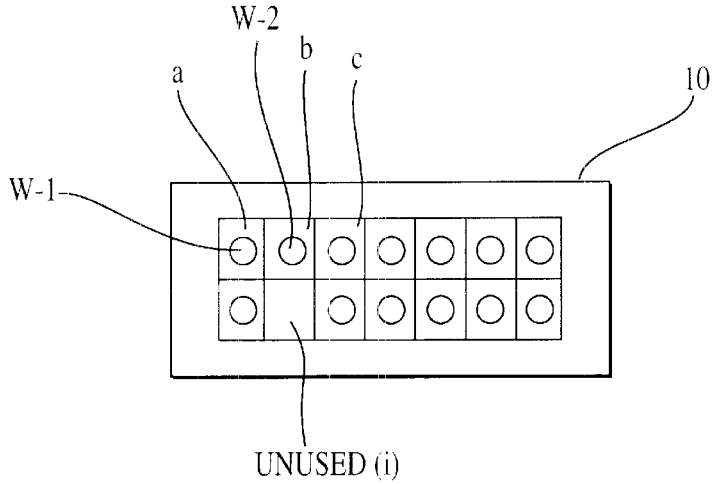
FIG. 7 shows the terminal receiving means to be engaged with the electrical cables of FIG. 6.

As shown in FIG. 7, when thirteen types of electrical cables W1 to W13 are used, the connector 10 to be engaged with the electrical cables of instrument panel harness includes 14 poles (for example, enclosures a, b, c, etc.) and one unused enclosure "i". All the other enclosures a, b, c, etc. can be inserted with W1~W13 having different base colors.

The number of thirteen thus used as necessary different cable color markings for a vehicle or automobile is merely one third (⅓) of the commonly used different color number (i.e., forty six). Further, the electrical cables with stripes are not used, so that the manufacturing costs for cables are drastically reduced.

Moreover, without striped colors, even small size cables can be distinguished easily, by merely comparing the base colors. The workload is thus greatly reduced.

Figure 8:
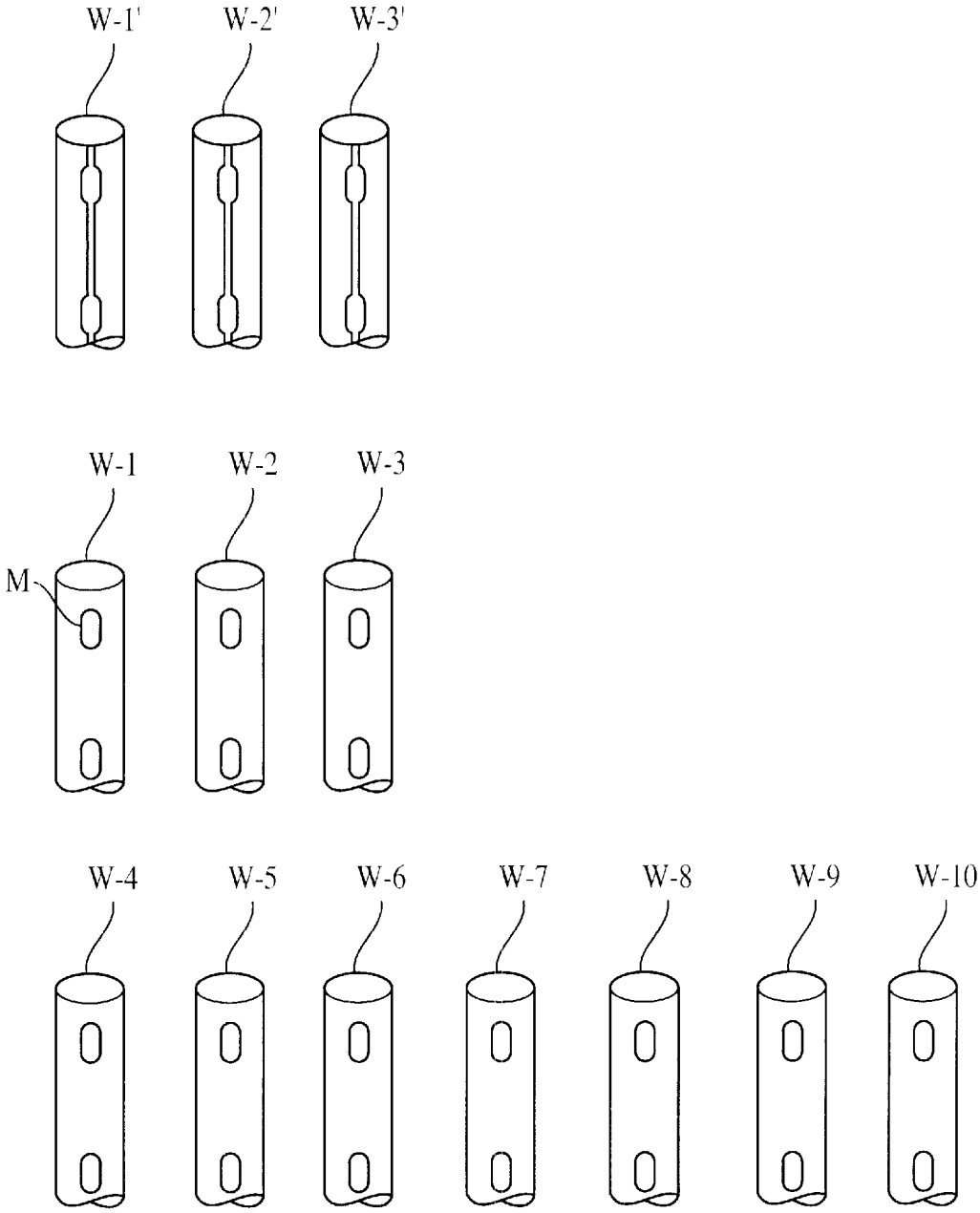
FIG. 8 shows a mixed use of the electrical cables having plain base colors with identification codes and those having striped base colors with identification codes.

FIG. 8 shows an alternative embodiment, in which thirteen colored electrical cables are apportioned between 10 base color electrical cables W1 to W10, and three striped color electrical cables W1', W2' and W3'.

In the above embodiment, the critical number of different cable color markings is considered to be thirteen. However, it can be less than thirteen, as long as the same color cables are prevented from being erroneously inserted into the connector enclosures, and from subsequent misconnections.

As can be understood from above, the critical number of different color markings is the maximum value. It may be less than thirteen such as, for example, eleven or ten.

Likewise, depending on the type of a vehicle or automobile, the number of electrical cables contained in the critical unitary wire harness may be smaller, and the connectors may contain fewer enclosures. Then, the critical number of different cable color markings may be less than thirteen.

According to the invention, the number of different cable color markings used, for example, in a vehicle or an automobile can now be reduced to about one third, compared to the prior art approach which was considered to be necessary. The manufacturing costs of the cables can thus be greatly reduced.

Further, as the required number of different cable color markings is reduced, the entirety of the electrical cables wired in a vehicle or automobile can be constructed of the base colored cables without stripes. Consequently, especially in the case of small-sized cables, it is no longer necessary to distinguish the stripe color from the base color. The burden on workers during connecting operation is thus reduced, and misconnections due to erroneous recognition of cable colors can be avoided.

Although the present invention has been described with reference to particular means, materials and embodiments, it is to be understood that the invention is not limited to the particulars disclosed and extends to all equivalents within the scope of the claims. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Patent Application No.2001-177630, filed on Jun. 12, 2001, which is herein expressly incorporated by reference in its entirety.

What is claimed is:

1. A method for determining a critical number of colors for electrical cables forming a wire harness, the wire harness including a plurality of unitary wire harnesses to be engaged with a given number of connectors, each of the unitary wire harnesses containing a plurality of electrical cables which respectively have a different color marking and include an electrical terminal attached to at least one end thereof, each of the connectors including a plurality of terminal receiving elements respectively adapted to receive a corresponding electrical terminal, so that each of the unitary wire harnesses can be engaged with a given number of connectors, said method comprising:

selecting a critical unitary wire harness among said plurality of unitary wire harnesses;

determining a critical number of different color markings to be contained in said critical unitary wire harness on the basis of the empirical formula:

$$R=A/B+C/B \quad \text{(I)}$$

in which R is the critical number of different color markings;

A is the total number of electrical cables contained in said critical unitary wire harness;

B is the total number of connectors to be engaged with said critical unitary wire harness; and C is the total number of terminal receiving elements contained in all of the connectors to be engaged with said critical unitary wire harness; and setting the total number of different cable color markings necessary for each of said plurality of unitary wire harnesses to be equal to or less than said critical number of different color markings.

2. The method according to claim 1, wherein selecting a critical unitary wire harness comprises choosing a unitary wire harness containing either the greatest number of electrical cables or the greatest number of connectors.

3. The method according to claim 1, wherein determining the critical number of different color markings comprises multiplying member R by a number equal to at least about 1.5, when C/B is less than about 9.

4. The method according to claim 3, wherein said number equal to at least about 1.5 is a number between about 1.5 and about 2.0, inclusive.

5. The method according to claim 1, wherein determining the critical number of different color markings comprises rounding up member R to the next highest integer, when said member R forms a decimal number.

6. The method according to claim 1, wherein said different color markings include a plain base color and/or a striped base color.

7. The method according to claim 1, wherein said different color markings comprise only plain base colors.

8. The method according to claim 1, wherein said different color markings comprise a maximum of thirteen types of color.

9. The method according to claim 1, wherein all of said different color markings used for a specific connector are different from one another, or wherein said terminal receiving elements in a specific connector are arranged such that either the same color markings are not placed in adjacent positions, or are placed in different sub-classes which are defined for said terminal receiving elements.

10. The method according to claim 1, wherein selecting a critical unitary wire harness comprises choosing a unitary wire harness containing at least thirty electrical cables.

11. The method according to claim 1, wherein said different color markings are further provided with markings along the length of said electrical cables at given intervals.

12. A system for determining a critical number of colors for electrical cables forming a wire harness, the wire harness including a plurality of unitary wire harnesses to be engaged with a given number of connectors, each of the unitary wire harnesses containing a plurality of electrical cables which respectively have a different color marking and include an electrical terminal attached to at least one end thereof, each of the connectors including a plurality of terminal receiving elements respectively adapted to receive a corresponding electrical terminal, so that each of the unitary wire harnesses can be engaged with a given number of connectors, said system comprising:

a selector that selects a critical unitary wire harness among said plurality of unitary wire harnesses;

an element that determines the critical number of different color markings to be contained in said critical unitary wire harness on the basis of the empirical formula:

$$R=A/B+C/B \quad \text{(I)}$$

in which R is the critical number of different color markings;

A is the total number of electrical cables contained in said critical unitary wire harness;

B is the total number of connectors to be engaged with said critical unitary wire harness; and C is the total number of terminal receiving elements contained in all of the connectors to be engaged with said critical unitary wire harness; and a device that sets the total number of different cable color markings necessary for each of said plurality of unitary wire harnesses to be equal to or less than said critical number of different color markings.

13. The system according to claim 12, wherein said selector that selects a critical unitary wire harness comprises a device that chooses a unitary wire harness containing either the greatest number of electrical cables or the greatest number of connectors.

14. The system according to claim 12, wherein said element that determines the critical number of different color markings comprises a device that multiplies member R by a number equal to at least about 1.5, when C/B is less than about 9.

15. The system according to claim 12, wherein said different color markings include a plain base color and/or a striped base color.

16. The system according to claim 12, wherein said different color markings comprise a maximum of thirteen types of color.

17. A vehicle wire harness comprising a plurality of unitary wire harnesses to be engaged with a given number of connectors, each of the unitary wire harnesses containing a plurality of electrical cables which respectively have a different color marking and include an electrical terminal attached to at least one end thereof, said unitary wire harnesses being configured to be engaged with said connectors including a plurality of terminal receiving elements that receive a corresponding electrical terminal, said vehicle wire harness comprising:

a critical unitary wire harness selected among said plurality of unitary wire harnesses;

a critical number of different color markings to be contained in said critical unitary wire harness, determined on the basis of the empirical formula:

$$R=A/B+C/B \quad \text{(I)}$$

in which R is the critical number of different color markings;

A is the total number of electrical cables contained in said critical unitary wire harness;

B is the total number of connectors to be engaged with said critical unitary wire harness; and C is the total number of terminal receiving elements contained in all of the connectors to be engaged with said critical unitary wire harness; and a necessary total number of different cable color markings determined for each of said plurality of unitary wire harnesses, which are equal to or less than said critical number of different color markings.

18. The vehicle wire harness according to claim 17, wherein said critical unitary wire harness comprises a unitary wire harness containing either the greatest number of electrical cables or the greatest number of connectors.

19. The vehicle wire harness according to claim 17, wherein said critical number of different color markings comprises member R multiplied by a number equal to at least about 1.5, when C/B is less than about 9.

20. The vehicle wire harness according to claim 17, wherein said different color markings include a plain base color and/or a striped base color and comprise a maximum of thirteen types of color.

* * * * *